US010464204B2

(12) United States Patent
Angold et al.

(10) Patent No.: US 10,464,204 B2
(45) Date of Patent: Nov. 5, 2019

(54) TOOL ARM MOUNT FOR AERIAL WORK PLATFORM

(71) Applicant: Ekso Bionics, Inc., Richmond, CA (US)

(72) Inventors: Russ Angold, American Canyon, CA (US); James Lubin, Oakland, CA (US); Mario Solano, Richmond, CA (US); Chris Paretich, Greenbrae, CA (US); Tom Mastaler, Hercules, CA (US)

(73) Assignee: Ekso Bionics, Inc., Richmond, CA (US)

( * ) Notice: Subject to any disclaimer, the term of this patent is extended or adjusted under 35 U.S.C. 154(b) by 338 days.

(21) Appl. No.: 15/420,309

(22) Filed: Jan. 31, 2017

(65) Prior Publication Data

US 2017/0217009 A1 Aug. 3, 2017

Related U.S. Application Data

(60) Provisional application No. 62/290,664, filed on Feb. 3, 2016.

(51) Int. Cl.
*B25H 1/00* (2006.01)
*B66F 11/04* (2006.01)

(52) U.S. Cl.
CPC ..... *B25H 1/0042* (2013.01); *B66F 11/04* (2013.01)

(58) Field of Classification Search
CPC ..... B25H 1/0042; B25H 1/0021; B66F 11/04
See application file for complete search history.

(56) References Cited

U.S. PATENT DOCUMENTS

| | | | | |
|---|---|---|---|---|
| 4,208,028 | A | 6/1980 | Brown et al. | |
| 4,265,147 | A | 5/1981 | Fox | |
| 5,113,768 | A | 5/1992 | Brown | |
| 5,360,196 | A | 11/1994 | DiGiulio et al. | |
| 5,435,515 | A | 7/1995 | DiGiulio et al. | |
| 5,683,063 | A * | 11/1997 | Seiders | B66F 11/044 248/214 |
| 5,797,571 | A | 8/1998 | Brophy | |
| 6,752,221 | B1 | 6/2004 | Morissette | |
| 6,848,540 | B2 | 2/2005 | Kvam | |
| 7,325,777 | B2 | 2/2008 | Thiessen | |
| 7,618,016 | B2 | 11/2009 | Brown | |
| 8,038,110 | B2 | 10/2011 | Talbott | |
| 9,156,154 | B2 | 10/2015 | Brown et al. | |

(Continued)

FOREIGN PATENT DOCUMENTS

| | | |
|---|---|---|
| GB | 2345313 | 7/2000 |
| JP | H0971398 | 3/1997 |

*Primary Examiner* — David P Bryant
*Assistant Examiner* — Nirvana Deonauth
(74) *Attorney, Agent, or Firm* — Diederiks & Whitelaw, PLC.

(57) ABSTRACT

A tool arm mount couples a tool arm to an aerial work platform. The tool arm mount includes a first mounting hook that hangs on a first rail of the aerial work platform and a second mounting hook that hangs on a second rail of the aerial work platform. The first mounting hook defines a first channel in which the first rail is received, and the second mounting hook defines a second channel in which the second rail is received. The first and second mounting hooks are coupled to a spine of the tool arm mount. The tool arm mount also includes a first lock that locks the first mounting hook to the first rail.

13 Claims, 6 Drawing Sheets

(56) References Cited

U.S. PATENT DOCUMENTS

| | | | |
|---|---|---|---|
| 9,204,730 | B2 | 12/2015 | Brown |
| 2005/0023015 | A1 | 2/2005 | Argento |
| 2005/0067361 | A1 | 3/2005 | Waymire |

* cited by examiner

TOOL ARM MOUNT FOR AERIAL WORK PLATFORM

CROSS REFERENCE TO RELATED APPLICATIONS

This application claims the benefit of U.S. Provisional Application No. 62/290,664, which was filed on Feb. 3, 2016 and titled "Aerial Work Platform". The entire content of this application is incorporated herein by reference.

FIELD OF THE INVENTION

The present invention relates to devices and methods that augment a person performing industrial work while on an aerial work platform (AWP). The devices augment a worker's ability to hold, position and operate industrial tools, increasing performance and aiding in the prevention of injury during the execution of certain strength-requiring tasks involving industrial tools that are being used on an AWP. More particularly, the present invention relates to unpowered devices suitable for use by a person engaging in heavy tool operation. In a preferred embodiment, an unpowered device is used with a non-anthropomorphic articulated arm and a tool holder, holding any one of a variety of different industrial tools, that potentiate improved functioning for activities including, but not limited to, greater strength and endurance in using and operating industrial tools while working at heights reachable through the use of an AWP.

BACKGROUND OF THE INVENTION

Businesses often employ AWPs to enable workers to reach and perform tasks at high elevations at both indoor and outdoor worksites. Workers can perform tasks more safely on AWPs than on ladders because the platform size, level workspace and safeguards (including safety belts and harnesses, rails and gates) permit suitable balance and freedom of motion for individuals performing construction, maintenance and operational tasks at heights up to multiple stories in elevation.

While the platform/basket designs of AWP work areas make it easier and safer to physically move and operate tools when high in the air, workers still must carry, lift and hold heavy machinery and tools while performing their work. Such lifting and strenuous activities can exhaust workers' strength and stamina and put workers at risk for acute as well as repetitive-activity injuries. In order to surmount these problems, businesses are beginning to employ gravity-balancing articulated arms that can offload the weight of these tools. Although such arms are not an object of the present invention, it is important to understand that a gravity-balancing arm can support a heavy tool in a way that allows a worker to move the tool without bearing the weight of the tool. It was seen that there exists an unmet need in the art to connect such gravity-balancing arms to AWPs.

SUMMARY OF THE INVENTION

The present invention is directed to a tool-holding and operating device that is to be mounted on AWPs. It is designed to work with a variety of AWP units, so the device's one size fits most available AWP units. The device can be fitted with many different sizes of tool holders so that a variety of tools and tool sizes can be used.

The device mounts and clamps onto the top and middle rails of an AWP. When secured in place, an articulated arm, tool holder and tool are added to the device. The resultant configuration takes all the weight/load of a tool and enables the worker to position and operate the tool, directing activity, angle and direction as needed for the work activity. All work is performed by the worker standing with his or her feet firmly positioned on the platform floor at all times and appropriate fail prevention equipment in use.

The device enables the worker to position the tool and keep it in place while activating the tool's power utility (such as drilling, sanding, chipping, etc.) without the effort and fatigue commonly associated with holding and operating a heavy industrial tool. During normal operation, the device, the tool-holding arm and tool holder transfer the vertical force required to hold the tool through the AWP rails and structure rather than through the worker's arms and body.

Although the tool may be powered, the device preferably is not. In this unpowered device, the structure of the tool-holding are and the tool, holder play a significant role in the usefulness of the device to the worker working in industrial tool use applications. By means of the employment of various sizes of tool holders, the device is suitable for use with a variety of tool and tool sizes that a worker may use in a variety of workplace activities.

Therefore, in a preferred embodiment, the device allows a worker to mount and secure the device to the rails of an AWP. An articulated arm, tool holder and tool are added to the device. The worker can then position and operate the tool, guiding activity, angle and direction as needed for the particular work activity. The device allows the worker to perform industrial tool-operating tasks without the strain and fatigue that would be present if the worker were lifting and holding the industrial tool during work activities.

In particular, the present invention is directed to a tool arm mount configured to couple a tool arm to an aerial work platform. The tool arm mount comprises a first mounting hook configured to hang on a first rail of the aerial work platform, the first, mounting hook defining a first channel in which the first rail is received. The tool arm mount also comprises a second mounting hook configured to hang on a second rail of the aerial work platform, the second mounting hook defining a second channel in which the second rail is received. The first and second mounting hooks are coupled to a spine of the tool arm mount. The tool arm mount further comprises a first lock configured to lock the first mounting hook to the first rail. The tool arm mount can also comprise a second lock configured to lock the second mounting hook to the second rail. Preferably, at least one of the first and second mounting hooks is J-shaped.

In one embodiment, the tool arm mount further comprises a slide configured to slide along the spine. The second mounting hook is coupled to the slide such that the second mounting hook moves with the slide.

Preferably, the first lock includes a U-shaped channel and a knob configured to slide within the U-shaped channel. When the knob is located in a first area of the U-shaped channel, the first lock is locked. When the knob is located in a second area of the U-shaped channel, the first lock is unlocked.

In one embodiment, the first lock further includes a roll pin. The knob is coupled to the roll pin. When the knob is located in the first area of the U-shaped channel, the roll pin prevents the first rail from entering or exiting the first channel. When the knob is located in the second area of the U-shaped channel, the roll pin does not prevent the first rail from entering or exiting the first channel. The first area of the U-shaped channel is closer to the first mounting hook than the second area of the U-shaped channel. When the knob is located in the first area of the U-shaped channel, the roll pin extends below the first channel.

Preferably, the first lock further includes a cylindrical body, and the roll pin is cylindrical. The roll pin moves within the cylindrical body when the knob slides within the U-shaped channel.

Additional objects, features and advantages of the invention will become more readily apparent from the following detailed description of preferred embodiments thereof when taken in conjunction with the drawings wherein like reference numerals refer to common parts in the several views.

DETAILED DESCRIPTION OF THE PREFERRED EMBODIMENTS

Detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting, but merely as a representative basis for teaching one skilled in the art to employ the present invention.

Figure 1:
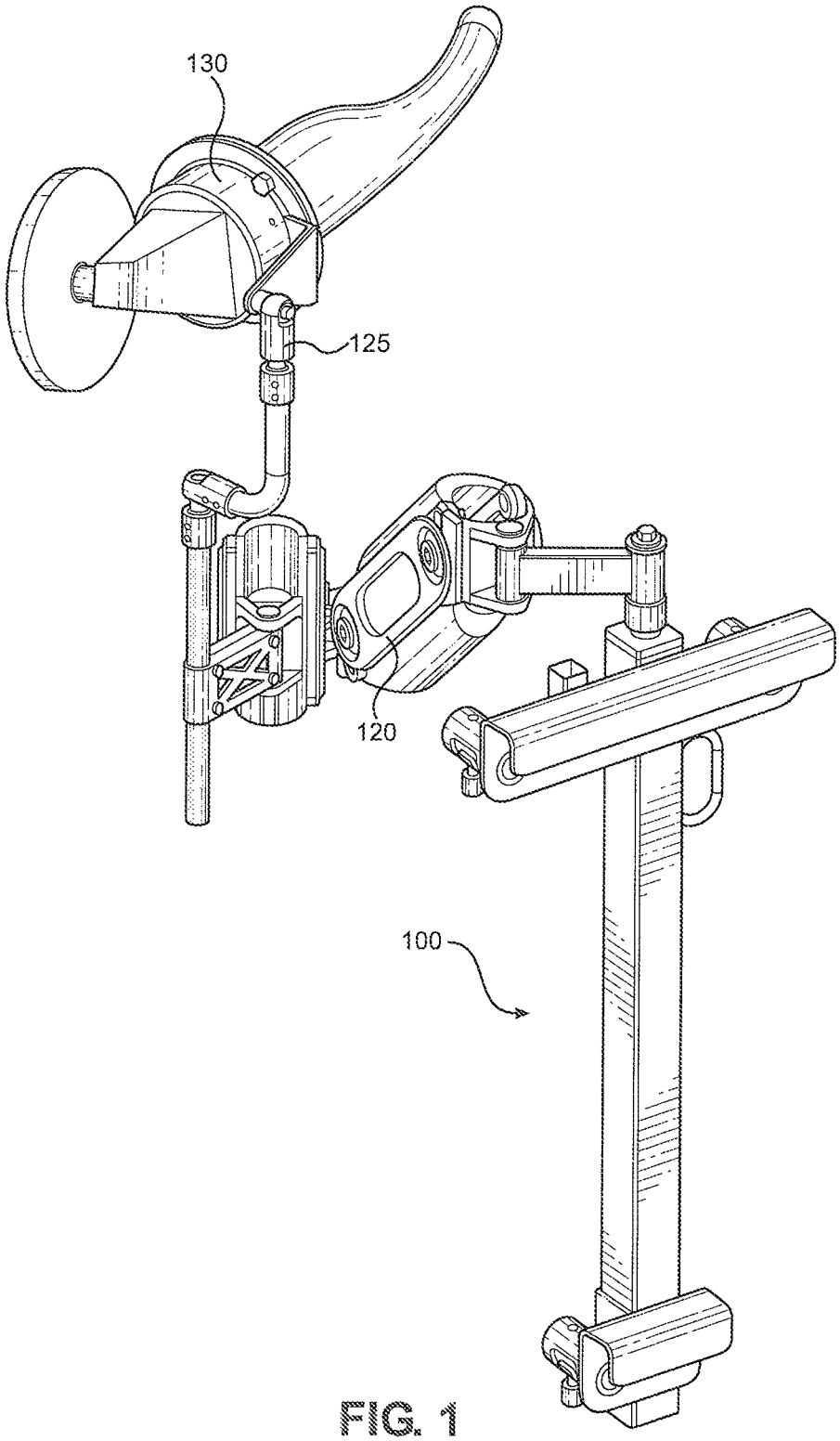
FIG. 1 is a perspective view of a tool arm mount constructed in accordance with the present invention. An articulated tool arm, tool holder and tool are also shown.

FIG. 1 is a perspective view of a tool arm mount 100 constructed in accordance with the present invention. Tool arm mount 100 is shown being used with an articulated tool arm 120, a tool holder 125 and a tool 130. Tool arm 120 allows the position of tool 130 to be adjusted relative to tool arm mount 100. Preferably, tool arm 120 is an unpowered gravity-counteracting tool arm. Typically, such tool arms use springs, either alone or with fluid dampers, to maintain the vertical position of a tool coupled thereto without the need for a user to exert any vertical force on the tool. In any case, it should be recognized that other tool arms can be used in connection with the present invention. Tool holder 125 couples tool 130 to tool arm 120 and allows the position of tool 130 to be adjusted relative to tool arm 120. Although tool arm mount 100 can be used with a wide variety of tools, tool 130 is illustrated as a grinder in FIG. 1.

Figure 2:
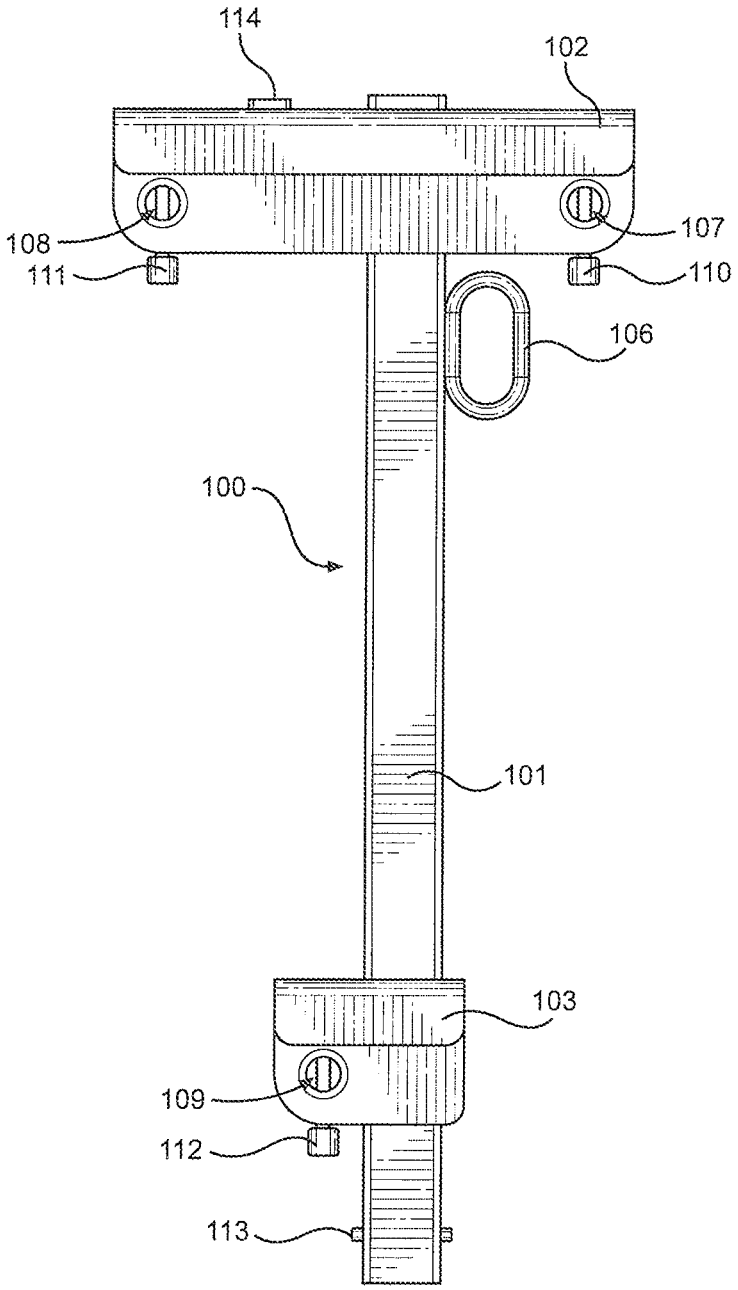
FIG. 2 is a front (anterior) view of the tool arm mount.
Figure 3:
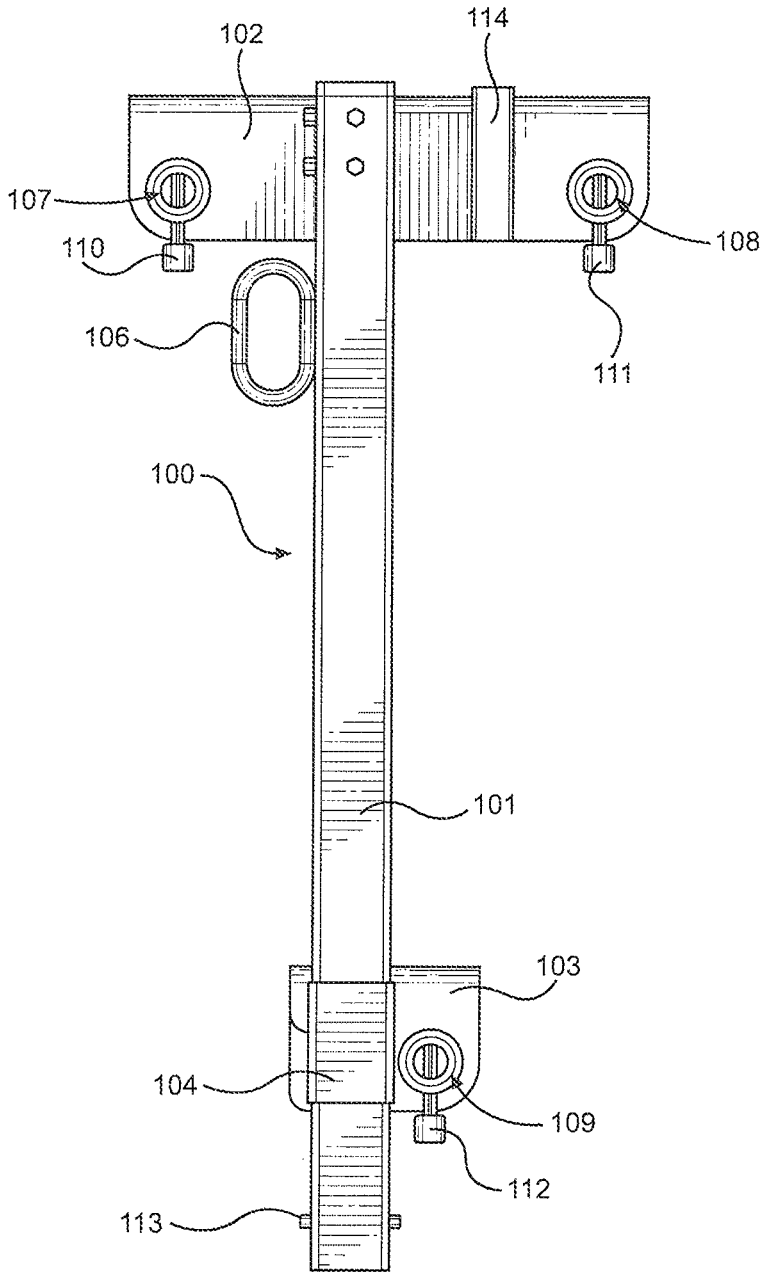
FIG. 3 is a rear (posterior) view of the tool arm mount.
Figure 4:
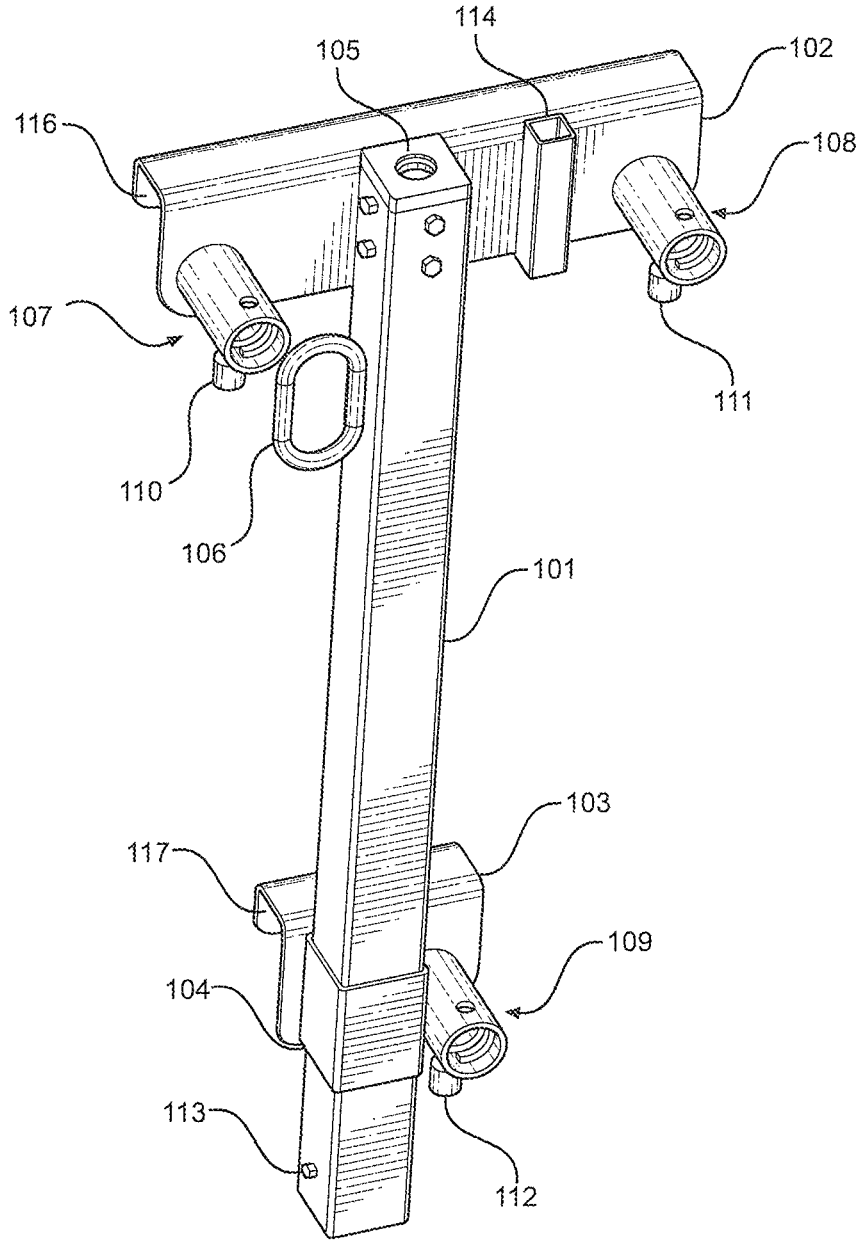
FIG. 4 is a perspective view of the rear of the tool arm mount.

FIG. 2 is a front (anterior) view of tool arm mount 100, while FIG. 3 is a rear (posterior) view of tool arm mount 100. FIG. 4 is a perspective view of the rear of tool al n mount 100. As can be seen in FIGS. 2-4, tool arm mount 100 includes a spine 101. An upper rail mounting hook 102 and a lower rail mounting hook 103 are coupled to spine 101. Mounting hooks 102 and 103 are J-shaped so that tool arm mount 100 can be hung on the guardrails of a platform (e.g., the guardrails of an AWP). Specifically, upper rail mounting hook 102 defines an upper channel 116 in which one guardrail can be received, and lower rail mounting hook 103 defines a lower channel 117 in which another guardrail can be received. Lower rail mounting hook 103 is coupled to a lower rail mounting hook slide 104, which slides up and down spine 101, thereby allowing tool arm mount 100 to be coupled to platform guardrails that are varying distances apart. This is advantageous because different platforms have different railing configurations and it is preferred that customers be able to adapt tool arm mount 100 to different platforms.

A tool arm receiver 105 (see FIG. 4) is located inside spine 101. Tool arm receiver 105 is used to couple tool arm 120 to tool arm mount 100. Safety tethers and lanyard connectors are commonly found on platforms such as AWPs. A lanyard safety link and handle 106 is attached to the upper part of spine 101 and provides a solid ring to which a lanyard can be connected. Lanyard safety link and handle 106 also provides an ergonomic handle by which tool arm mount 100 can be carried to and from a worksite.

Upper rail mounting hook 102 features two locks 107 and 108, while lower rail mounting hook 103 features one lock 109. Each of locks 107-109 is a cylindrical body with a lock lever 110-112. Each of lock levers 110-112 includes a knob and a roll pin. Locks 107-109 are used to secure tool arm mount 100 to platform guardrails. Although there are many locking mechanisms that can be used with the present invention, it is particularly important in this application that the locking mechanisms be simple so that a user can ensure tool arm mount 100 is securely attached to the platform and so that contamination from dirt and debris does not bind the lock mechanisms shut.

A lower rail mounting hook slide captive pin 113 prevents lower rail mounting hook slide 104 from detaching from spine 101. A tool staging receptacle 114 can be used at a user's discretion to store or keep at the ready tool holders and/or tools before or after attachment to tool mount receiver 105.

Figure 5A:
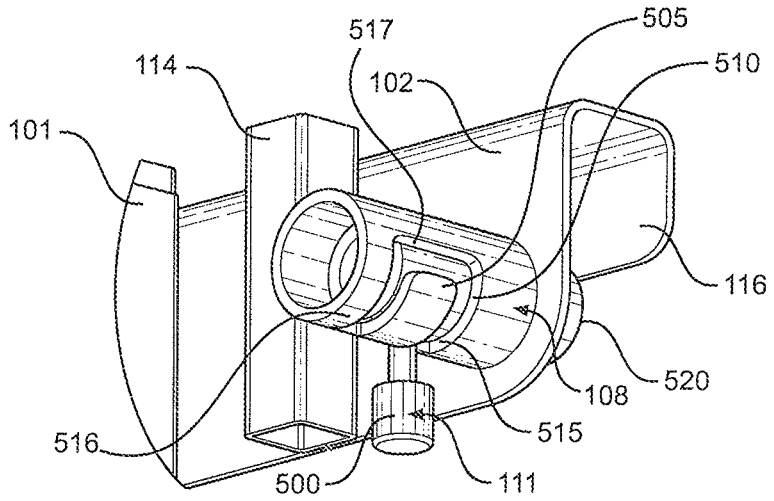
FIG. 5A is a perspective view of a lock of the tool arm mount in a locked position.
Figure 5B:
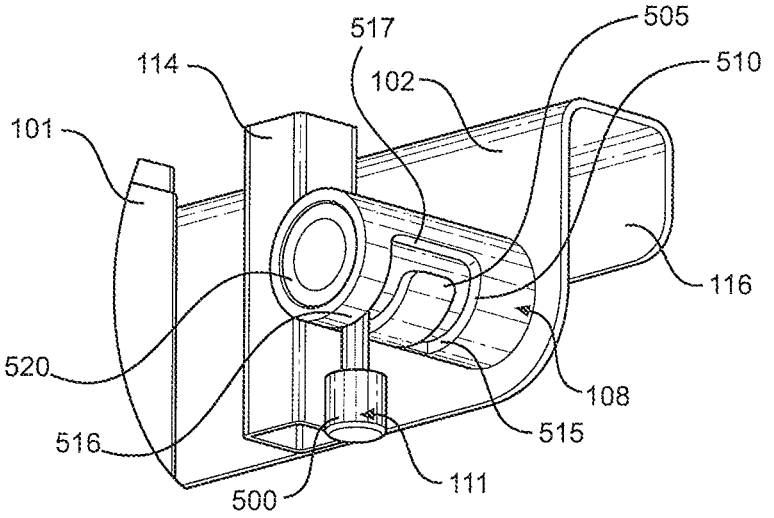
FIG. 5B is a perspective view of the lock in an unlocked position.

FIGS. 5A and 5B illustrate how tool arm mount 100 is locked to and unlocked from a platform by means of locks 107-109. Specifically, FIGS. 5A and 5B focus on lock 108. However, locks 107 and 109 are preferably constructed in the same manner. The design of lock 108 reduces the chance of inadvertent unlocking, of tool arm mount 100 from a platform. A user must intentionally slide a knob 500 of lock lever 111 around a protrusion 505 to shift between the locked and unlocked positions. In particular, knob 500 slides within a U-shaped channel 510, which is defined, in part, by protrusion 505. Channel 510 has three areas 515-517 corresponding to the legs and base of the "U". When knob 500 is located in area 515, lock 108 is locked, as shown in FIG. 5A. In this locked state, a roll pin 520 of lock lever 111 extends below channel 116, thereby preventing a platform guardrail (not shown) from entering or exiting channel 116. Knob 500 is coupled to roll pin 520, and, when knob 500 slides within channel 510, roll pin 520 moves within the cylindrical body of lock 108. To unlock lock 108, knob 500 is moved through area 517, which represents an intermediate transitional area, until knob 500 reaches area 516. When knob 500 is located in area 516, lock 108 is unlocked, as shown in FIG. 5B. In this unlocked state, roll pin 520 does not extend below channel 116. Accordingly, roll pin 520 does not prevent a platform guardrail from entering or exiting channel 116, and tool arm mount 100 can be coupled to or uncoupled from a platform.

Figure 6:
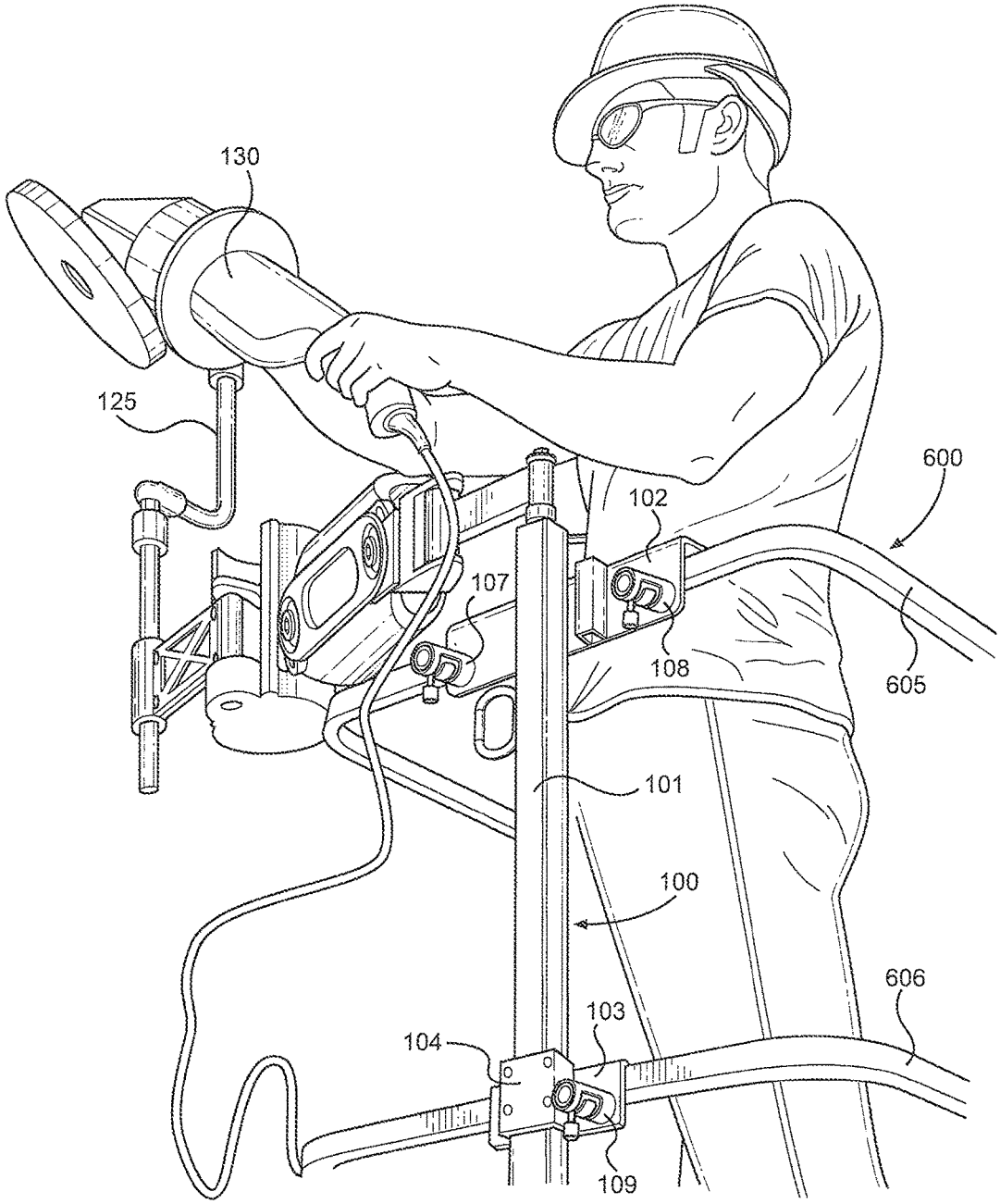
FIG. 6 shows the tool arm mount attached to a platform in a work environment.

FIG. 6 shows tool arm mount 100 attached to a platform 600 in a work environment. Platform 600 is shown as an AWP. For purposes of the present invention, the term "AWP" includes any elevated platform designed to support a worker during performance of the worker's duties. Such platforms can include scaffolding, for example, as well as movable platforms mounted to motor vehicles. Platform 600 includes two vertically spaced guardrails 605 and 606 to which tool arm mount 100 is coupled. Specifically, upper rail mounting hook 102 is in contact with guardrail 605 and lower rail mounting, hook 103 is in contact with guardrail 606. To couple tool arm mount 100 to platform 600, lower rail mounting hook 103 is slid along spine 101 until the distance between mounting hooks 102 and 103 is less than the distance between guardrails 605 and 606. Upper rail mounting hook 102 is then hung on guardrail 605. Next, lower rail mounting hook 103 is slid along spine 101 until lower rail mounting hook 103 contacts guardrail 606. At this point, the distance between mounting hooks 102 and 103 is the same as the distance between guardrails 605 and 606. Tool arm mount 100 is then locked into place using locks 107-109. To uncouple tool arm mount 100 from platform 600, locks 107-109 are unlocked, and tool arm mount 100 is lifted off guardrails 605 and 606. Tool arm mount 100 can then be carried to another location using handle 106.

Based on the above, it should be readily apparent that the present invention provides a way to connect gravity-balancing tool anus to platforms such as AWPs. In particular, the present invention provides a way for a worker to easily connect a gravity-balancing tool arm to and disconnect the gravity-balancing arm from an AWP in real-world work environments. In addition, the worker is able to easily carry a tool arm mount of the present invention between work areas. Although described with reference to preferred embodiments, it should be readily understood that various changes or modifications could be made to the invention without departing from the spirit thereof. In general, the invention is only intended to be limited by the scope of the following claims.

The invention claimed is:

1. A tool arm mount configured to couple a tool arm to an aerial work platform, the tool arm mount comprising:

a first mounting hook configured to hang on a first rail of the aerial work platform, the first mounting hook defining a first channel in which the first rail is received;

a second mounting hook configured to hang on a second rail of the aerial work platform, the second mounting hook defining a second channel in which the second rail is received;

a spine, wherein the first and second mounting hooks are coupled to the spine; and a first lock configured to lock the first mounting hook to the first rail, wherein the first lock includes a U-shaped channel and a knob configured to slide within the U-shaped channel, wherein, when the knob is located in a first area of the U-shaped channel, the first lock is locked, and, when the knob is located in a second area of the U-shaped channel, the first lock is unlocked.

2. The tool arm mount of claim 1, wherein at least one of the first mounting hook and the second mounting hook is J-shaped.

3. The tool arm mount of claim 1, further comprising a second lock configured to lock the second mounting hook to the second rail.

4. The tool aim mount of claim 1, further comprising a slide configured to slide along the spine, wherein the second mounting hook is coupled to the slide such that the second mounting hook moves with the slide.

5. The tool arm mount of claim 1, wherein:

the first lock further includes a roll pin;

the knob is coupled to the roll pin;

when the knob is located in the first area of the U-shaped channel, the roll pin prevents the first rail from entering or exiting the first channel; and when the knob is located in the second area of the U-shaped channel, the roll pin does not prevent the first rail from entering or exiting the first channel.

6. The tool arm mount of claim 5, wherein:

the first area of the U-shaped channel is closer to the first mounting hook than the second area of the U-shaped channel; and when the knob is located in the first area of the U-shaped channel, the roll pin extends below the first channel.

7. The tool arm mount of claim 5, wherein:

the first lock further includes a cylindrical body;

the roll pin is cylindrical; and the roll pin moves within the cylindrical body when the knob slides within the U-shaped channel.

8. The tool arm mount of claim 1, wherein the tool arm mount is part of a work assembly including the aerial work platform, the tool arm, a tool holder and a tool.

9. A method of coupling a tool arm to an aerial work platform with a tool arm mount including a first mounting hook, a second mounting hook, a spine and a first lock, the method comprising:

hanging the first mounting hook on a first rail of the aerial work platform, the first mounting hook defining a first channel in which the first rail is received, wherein the first mounting hook is coupled to the spine;

hanging the second mounting hook on a second rail of the aerial work platform, the second mounting hook defining a second channel in which the second rail is received, wherein the second mounting hook is coupled to the spine;

locking the first mounting hook to the first rail with the first lock, wherein the first lock includes a U-shaped channel and a knob configured to slide within the U-shaped channel;

locating the knob in a first area of the U-shaped channel to lock the first lock; and locating the knob in a second area of the U-shaped channel to unlock the first lock.

10. The method of claim 9, wherein the second mounting hook is coupled to the spine via a slide, the method further comprising sliding the slide along the spine such that the second mounting hook moves along the spine.

11. The method of claim 9, wherein the first lock further includes a roll pin and the knob is coupled to the roll pin, the method further comprising:

when the knob is located in the first area of the U-shaped channel, preventing the first rail from entering or exiting the first channel by the roll pin; and when the knob is located in the second area of the U-shaped channel, enabling the first rail to enter or exit the first channel.

12. The method of claim 11, wherein, when the knob is located in the first area of the U-shaped channel, the roll pin extends below the first channel.

13. The method of claim 11, wherein the first lock further includes a cylindrical body and the roll pin is cylindrical, the method further comprising:

causing the roll pin to move within the cylindrical body when sliding the knob within the U-shaped channel.

* * * * *